United States Patent [19]

Lagally et al.

[11] Patent Number: 4,718,479

[45] Date of Patent: Jan. 12, 1988

[54] ANTIVIBRATION BAR INSTALLATION APPARATUS

[75] Inventors: Hermann O. Lagally, Hempfield Township, Westmoreland County; John H. Stevens, Murrysville, both of Pa.

[73] Assignee: Westinghouse Electric Corp., Pittsburgh, Pa.

[21] Appl. No.: 773,274

[22] Filed: Sep. 6, 1985

[51] Int. Cl.[4] ..... F28F 7/00

[52] U.S. Cl. ..... 165/69; 165/162

[58] Field of Search ..... 165/69, 162

[56] References Cited

U.S. PATENT DOCUMENTS

| | | | |
|---|---|---|---|
| 3,007,679 | 11/1961 | Byerley et al. | 257/239 |
| 3,199,582 | 8/1965 | Vogt et al. | 165/69 |
| 3,212,567 | 10/1965 | Romanos | 165/69 |
| 3,292,691 | 12/1966 | Welter et al. | 165/162 |
| 3,360,039 | 12/1967 | Frei | 165/172 |
| 3,637,008 | 1/1972 | Michel et al. | 165/69 |
| 3,864,811 | 2/1975 | Walker | 165/162 |
| 3,907,031 | 9/1975 | Tegethoff | 165/162 |
| 3,937,277 | 2/1976 | Krolmann et al. | 165/162 |
| 3,941,188 | 3/1976 | Scheidl | 165/162 |
| 4,204,570 | 5/1980 | Eisinger | 165/69 |
| 4,336,614 | 6/1982 | Mitchell et al. | 165/162 X |

FOREIGN PATENT DOCUMENTS

| | | | |
|---|---|---|---|
| 2200462 | 4/1974 | France | 165/162 |
| 813152 | 5/1959 | United Kingdom | 165/162 |
| 956129 | 4/1964 | United Kingdom | 165/162 |
| 1017455 | 1/1966 | United Kingdom | 165/162 |
| 1050025 | 12/1966 | United Kingdom | 165/69 |
| 1090535 | 11/1967 | United Kingdom | 165/162 |
| 1188564 | 4/1970 | United Kingdom | 165/162 |
| 1364571 | 8/1974 | United Kingdom | 165/69 |
| 1532100 | 11/1978 | United Kingdom | 165/162 |
| 1566633 | 5/1980 | United Kingdom | 165/69 |
| 2151766 | 7/1985 | United Kingdom | 165/69 |

*Primary Examiner*—Albert W. Davis, Jr.
*Assistant Examiner*—Peggy Neils

[57] ABSTRACT

Mechanical attachment apparatus is disclosed whereby antivibration bars are attached to a retaining ring at the location of the bent or curbed portion of the flow tube bundle of a stream generator adapted for use with a nuclear power plant. The mechanical attachment apparatus can be used with passive or expandable antivibration bars. A cylindrical member having a relatively long hook member attached thereto is connected to the ends of the antivibration bars. The hook member allows for wide variations in positioning when attaching the antivibration bars to a retaining ring located at and conforming to the periphery of the tube bundle. Latch apparatus secures the ring within the hook member. The attachment apparatus and the installation procedure are adapted to be performed under water using long-handled tools.

3 Claims, 7 Drawing Figures

ANTIVIBRATION BAR INSTALLATION APPARATUS

CROSS REFERENCE TO RELATED APPLICATIONS

This application is related to U.S. patent application Ser. No. 745,980 pending filed June 18, 1985, entitled "Compliant Antivibration Bar for a Steam Generator" by H. O. Lagally, et al, and U.S. patent application Ser. No. 729,385, filed May 1, 1985, Now U.S. Pat. No. 4,653,576 entitled "Expandable Antivibration Bar for a Steam Generator" by H. O. Lagally, both of which are assigned to the Westinghouse Electric Corporation.

BACKGROUND OF THE INVENTION

1. Field of the Invention

This invention relates in general to the field of steam generators for commercial nuclear power plants and in particular to apparatus for preventing vibration of the tubes of steam generators and more particularly to apparatus for eliminating clearance space between the tubes of a steam generator and the antivibration bars disposed between the columns of the tubes and thereby eliminating the vibration of said tubes during operation of the steam generator.

2. Description of the Prior Art

Nuclear power plants have been safely producing electricity for many years. The principal of operation of such commercial nuclear power plants is well known. A nuclear core containing fissionable fuel is caused to achieve criticality and therby produces heat. The heat is removed by a reactor coolant, which in the field of pressurized water reactors, comprises water. The water reactor coolant also serves as a nuclear moderator which thermalizes fast neutrons in order to enhance the probability of the neutrons producing additional nuclear fissions and thereby sustaining the nuclear reaction. Since the chain reaction is dependent upon the presence of the nuclear moderator, the absence of the same stops the chain reaction and shuts down the reactor. This is only one of the inherent safety features of a water-cooled nuclear reactor which contributes to the overall high safety factor of such reactors.

The heat produced by the nuclear core is transferred to the reactor coolant as it passes through the nuclear core. The reactor coolant subsequently transfers the heat it has received to another medium, which also comprises water and which is transferred into steam. The steam is then used to generate electricity by conventional steam turbine-electrical generator apparatus.

The reactor coolant transfers its heat to the secondary medium in steam generators specifically designed for the nuclear power field. The design of such nuclear steam generator is well known in the art. In general, the steam generator design comprises a plurality of small diameter tubes which are housed within a pressure bearing contained in such a manner as to allow and promote the transfer of heat to produce steam.

In particular, the design of the nuclear steam generators includes an outer shell comprising an elongated cylinder having rounded ends attached thereto. A large number of U-shaped tubes oriented along the longitudinal axis of the cylinder, are disposed in the lower cylindrically-shaped portion of the steam generator. The lower portion has a lower or bottom end thereof associated with a channel head typically of a hemispherical configuration. The channel head is divided by a partition into a first half typically known as the hot leg, and a second half typically known as the cold leg. The high temperature reactor coolant from the nuclear reactor is input into the steam generator through a primary coolant inlet nozzle into the hot leg. The reactor coolant then flows from the hot leg into the exposed openings of the plurality of U-shaped tubes, through the tubes and then through the cold leg portion of the channel head. Finally, the reactor coolant exits from the steam generator through a primary coolant outlet nozzle.

The portion of the steam generator primarily including the bundle of U-shaped tubes and the channel head is typically referred to as the evaporator section. The steam generator further includes a steam drum section which is located at the upper end of the cylindrical shell of the steam generator. A moisture separator is located within the steam drum section. Feedwater enters the steam generator through an inlet nozzle which is disposed in the upper portion of the cylindrical shell. The feedwater is distributed and mixed with water moved by the moisture separation and then flows down an annular channel surrounding the tube bundle. The feedwater then reverses direction and passes up around the outside of the tubes of the tube bundle where it absorbs heat from the reactor coolant flowing withing the tubes. The heat absorbed causes the feedwater to boil and produce steam. The steam produced by the boiling water rises into the steam drum section. The moisture separator then removes the water entrained within the steam before it exits from the steam generator through a steam outlet. The steam then flows to the steam turbine which is connected to an electrical generator. Subsequently, the steam from the steam turbine is condensed and rerouted into the steam generator to continue the flow cycle.

The U-shaped tubes are supported at their open ends by conventional means whereby the ends of the tubes are seal welded to a tube sheet which is disposed transverse to the longitudinal axis of the steam generator. A series of tube supports arranged in spaced relationship to each other are provided along the straight portion of the tubes in order to support such portion of the tubes. An upper tube support assembly is utilized to support the U portion of the tubes of the tube bundle. The upper assembly comprises a plurality of retainer rings arranged around the outside of the tube bundle. The upper assembly comprises a plurality of retainer rings arranged around the outside of the tube bundle in spaced relationship to each other.

The retainer rings, like the tube supports, are arranged substantially transverse to the longitudinal axis of the steam generator. Each retaining ring is generally of an oval shape which coincides with the outer periphery of the tube bundle at the particular location of the retaining ring. Thus, the size of the oval of the retaining rings decreases with the distance toward the end of the tube bundle. The upper most retaining ring, therefore, may be of relatively small, roughly circular diameter inasmuch as it is located at the uppermost portion of the tube bundle where the shape of the tube bundle is rapidly converging.

Each of the retaining rings is connected to a plurality of antivibration bars which are typically disposed between each column of the U-shaped tubes. The vibration bars in the prior art comprise a tube or bar bent into a V-shaped configuration such that two legs are formed with an angle therebetween. The V-shaped members are inserted between successive columns of the steam generator flow tubes. The V ends of the members are inserted between the flow tubes; the free ends of the V members are welded to opposite sides of the appropriate retainer ring. In this manner, each of the tubes of the tube bundle is supported along the length of the curved or U-shaped portion at a number of spaced locations by an antivibration bar. This arrangement provides point support and yet allows the feedwater to flow around and between the curved portion of the steam generator tubes. In other words, the antivibration bars provide support and do not substantially interfere with the flow of the feedwater.

The antivibration bars are intended to prevent vibrations of the individual tubes of the entire tube bundle. It is well known that the vibrations in question are caused by flow of the water and steam past the flow tubes. These flow-induced vibrations can potentially damage the flow tubes. It is also well known that the U-shaped portion of the tube bundle is most severely affected by the vibrations; and, because of the bent configuration, the most difficult to adequately support in order to eliminate the flow-induced vibrations. Further, it is well accepted that current hydraulic technology cannot adequately define nor eliminate the root cause of the vibrations. It has been, therefore, left to mechanical means to attempt to completely or at least substantially eliminate the vibration problem. While the advent of the antivibration bars or similar technology has materially reduced the magnitude and presence of vibrations, they have not completely eliminated the vibrations.

The mechanical aspects of the curved or bent portion of the tubes of the tube bundle are the major obstacles in the way of a mechanical solution to the problem.

The U-shaped tubes of the tube bundle have dimensional tolerances associated with their outer diameter. There are also variations caused by ovalization of the tubes as a result of the bending. Furthermore, the spatial relationship between adjacent tubes is a variable, albeit within set design limits. Thus, there is a dimensional tolerance associated with the nominal spacing between the steam generator tubes. There is also a dimensional tolerance associated with the outer dimensions of the prior art vibration bars, which as explained above, typically comprise square bars. They may also comprise a round, an oval, or any other shape having a uniform or a non-uniform cross-sectional shape. However, notwithstanding the particular shape chosen, there is the dimensional tolerance associated with the size of the bars. The combination of these tolerances and dimensional variances prevents the elimination of gaps beteen the antivibration bars and the tubes of the steam generator. Any gaps are, of course, very undesirable because they allow vibration of the tubes and relative motion between the tubes and the antivibration bars. The relative motion can cause wear and subsequent failure of the tubes of the steam generator. There have been numerous attempts in the prior art to minimize the gaps. Unfortunately, decreasing the size of the gaps only decreases the magnitude of the problem—it does not eliminate the problem.

In U.S. patent application Ser. No. 670,728 pending, filed 11/13/84 by B. C. Gowda, et al, and assigned to the Westinghouse Electric Corporation, a novel approach is disclosed to eliminate gaps between the steam generator tubes and the antivibration bars. That application provided a method whereby hollow antivibration bars are expanded in place between the columns of steam generator tubes to eliminate the gaps due to dimensional variations. While such method is obviously a step in the right direction, it does have its limitations. Such method is difficult to use with previously operated steam generators which may be or are radioactive and where it is required to perform the installation under water with remotely operated tools and where the spacing between adjacent tubes is further variable due to a buildup of deposits due to steam generator operation.

Copending patent application, filed simultaneously herewith, entitled "Flexible Antivibration Bar for Steam Generators" by H. O. Lagally, et al, is another approach to eliminate the gaps which exist between the prior art antivibration bars and the steam generator flow tubes. In this application, the flexibility of the supporting plates of the antivibration bars accommodate the variations in the actual distance between the columns of flow tubes.

Yet another approach to eliminate gaps between antivibrator bars and steam generator flow tubes is disclosed in copending patent application entitled "Expandable Antivibration Bars for a Steam Generator" by H. O. Lagally. In this application, split antivibration bars are disclosed which includes mating sets of inclined planes between the split halves. Relative motion between the split halves increases the height of the bars to completely fill the space between columns of flow tubes.

The above-mentioned flexible and expandable antivibration bars are adaptable to be installed in a new-being-build steam generator where there is ample room to maneuver the various components and to use installation tools—all at a close range. They are also adaptable to be installed in a previously built and operated steam generator where the original antivibration bars and retaining rings must first be removed and where all the work must be carried out under water using long-handled tools and using remote viewing television cameras.

Thus, in accordance with the above-noted, most recent advancements in the art of antivibration bars, there is the need to be able to install the new and advanced antivibration bars in previously built and operated steam generators. Such installation problems are unique to remote operating procedures especially in view of the possible radioactive nature of the steam generator.

Accordingly, an object of the present invention is to provide apparatus which allows installation of expandable and/or flexible antivibration bars in a previously built and operated steam generator.

Another object of the present invention is to provide apparatus which allows installation of expandable and/or flexible antivibration bars in a previously built steam generator using mechanical elements and without welding inside the steam generator.

Another object of the present invention is to provide apparatus which allows installation of expandable and/or flexible antivibration bars in a previously built and operated steam generator and where a relatively wide range of positioning variability of the antivibration bars is anticipated.

Another object of the present invention is to provide antivibration bar installation apparatus for use with a previously built and operated steam generator such that there are no loose parts or potential for loose parts subsequent to the installation.

Another object of the present invention is to provide antivibration bar installation apparatus which is capable of being used to install antivibration bars under water using long-handled tools and using remote viewing apparatus.

SUMMARY OF THE INVENTION

The above explicitly-stated objects as well as those not stated but implied based upon a fair reading and interpretation of this specification, claims and drawings, are achieved by the present invention which comprises apparatus for installing flexible and/or expandable antivibration bars using remote installation techniques in a steam generator which has previously been operated and is located at a nuclear facility where the steam generator is installed.

Mechanical attachment apparatus is utilized to attach the replacement antivibration bars to a specially provided restraining ring. The mechanical attachment apparatus is connected to the ends of the antivibration bars by means of a relatively large hook which is attached to the body of the mechanical attachment apparatus. The hook is used to engage the restraining ring. A latch mechanism engages the end of the hook so as to capture the restraining ring within the hook. The latch mechanism is activated by a screw threat arrangement which is readily accessible by remote operated tools. All rotatable parts are captured by locking devices to prevent loose parts in the unlikely event of breakage. The wide latitude afforded by the large hooks allows for positive attachment of the antivibration bars notwithstanding positioning tolerances of the rows of antivibration bars themselves, the positioning tolerances of the retaining ring, and the positioning tolerances of the columns of steam generator flow tubes.

Various other objects, advantages and features of the invention will become apparent to those skilled in the art from the following discussion taken in conjunction with the following drawings, in which:

DESCRIPTION OF THE PREFERRED EMBODIMENTS

Figure 1:
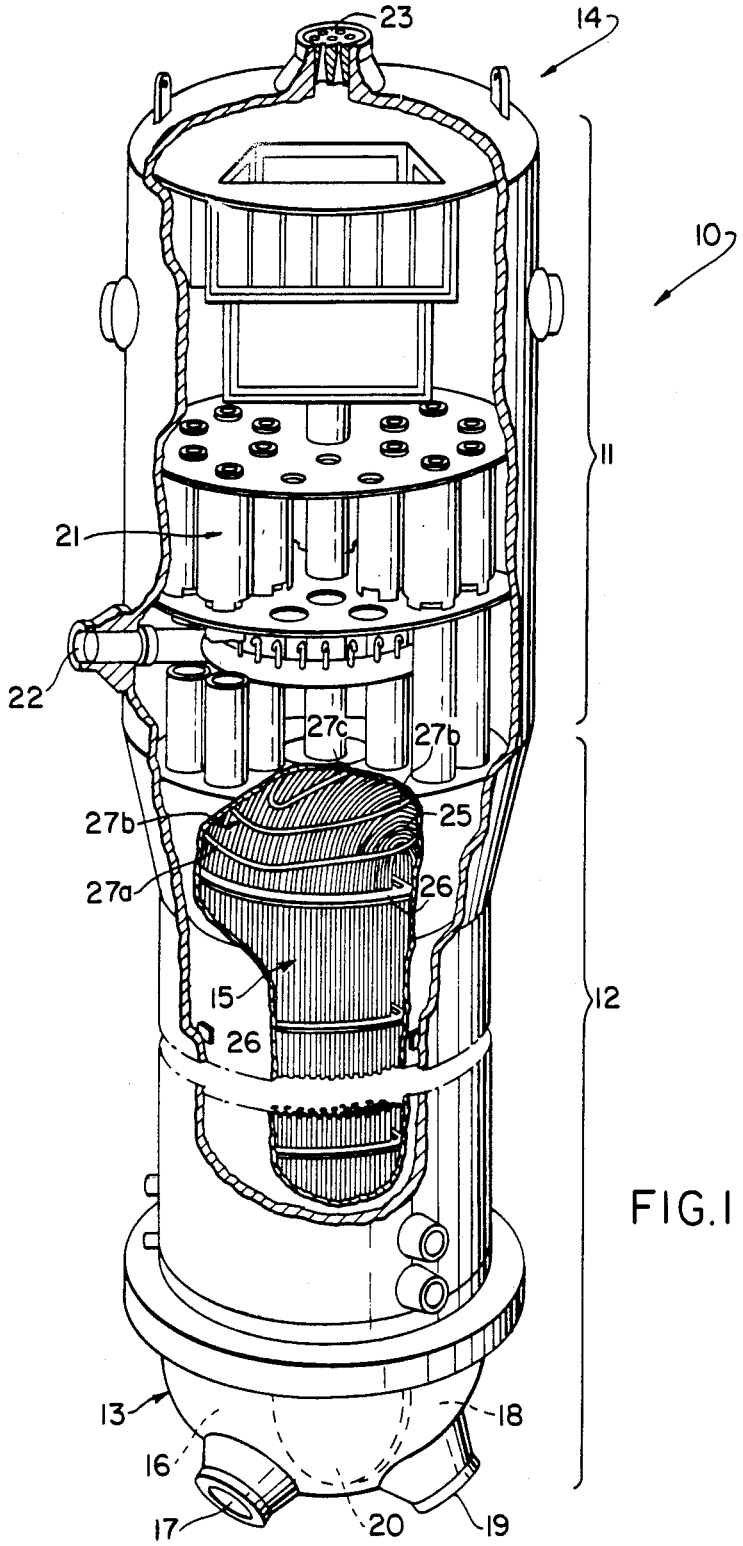
FIG. 1 is a perspective view, partially in cross section, of a nuclear steam generator, having U-shaped, bent flow tubes to which replacement antivibration bars are to be remotely installed.
Figure 2:
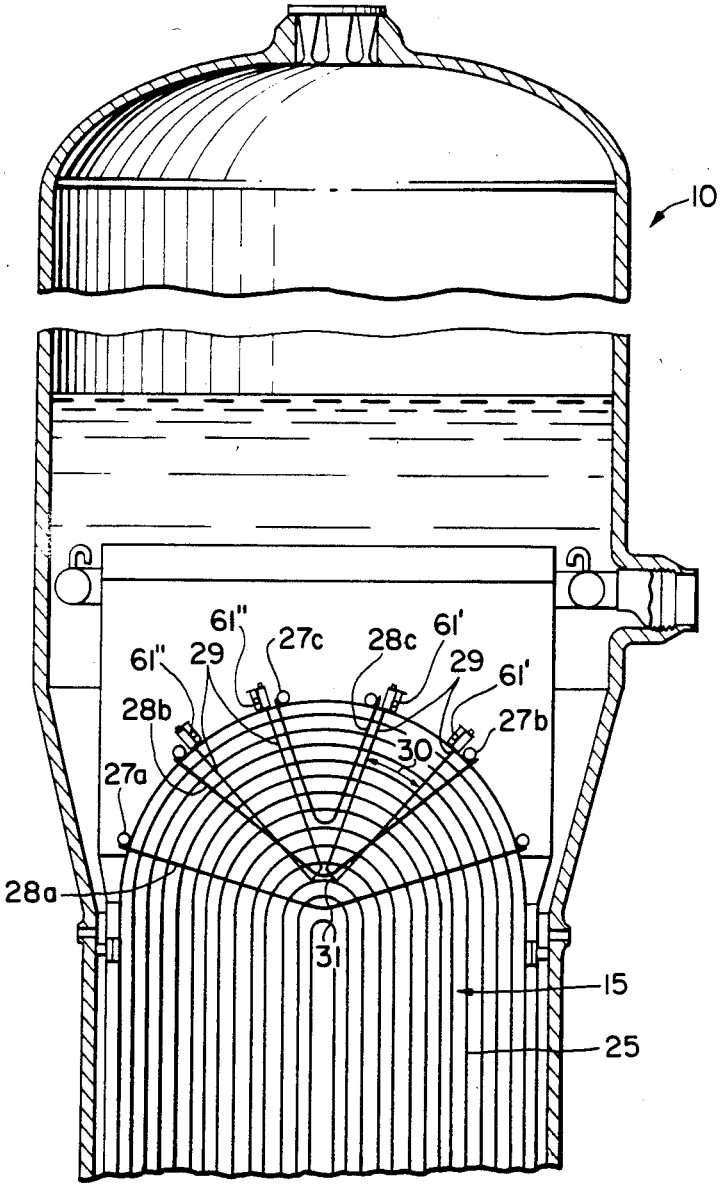
FIG. 2 is a schematic rendering of an axial cross section of the upper part of the steam generator of FIG. 1, particularly illustrating the bent portion of the flow tubes and typical installed positions of antivibration bars which may comprise expandable and/or flexible antivibration bars or prior art bars which are to be removed and replaced by expandable and/or flexible antivibration bars.

Referring now in general to the drawings where like characteristics are referred to by the same reference numerals among the various figures and in particular to FIGS. 1 and 2 which depict a typical steam generator to which the present invention may be applied. To the extent that the steam generator is described and explained in the description of prior art above, that description and explanation of operation is incorporated in the embodiment shown and described herein by reference as if fully set forth.

Nuclear steam generator 10 comprises a substantially cylindrical shell having upper 11 and lower 12 portions. A semispherical head or channel head 13 is sealingly attached to the lower portion 12, another head 14 is sealingly attached to the upper portion 11. A bundle 15 of U-shaped tubes is disposed within the lower portion 12. One open end of the tube bundle 15 is in flow communication with the hot leg 16 of channel head 13 and a primary coolant flow inlet nozzle 17. The other open end of the tube bundle 15 is in flow communication with the cold leg 18 of channel head 13 and a primary coolant flow outlet nozzle 19. A partition 20 divides the hot 16 and cold 18 legs of the channelhead 13. Thus, hot reactor coolant flows into steam generator 10 through inlet nozzle 17, through hot leg 16 into, through, and out of tube bundle 15. The now cooled reactor coolant flows through cold leg 18 and out of outlet nozzle 19 and back to the nuclear reactor to continue the flow cycle.

The lower portion 12 of the steam generator 10 primarily including the tube bundle 15 and channel head 13 is referred to as the evaporator portion. The upper portion 11 of steam generator 10 is normally referred to as the steam drum portion which includes one or more moisture separators 21. Feedwater enters the steam generator 10 through an inlet nozzle 22 and mixes with water removed by moisture separators 21. The feedwater flows down an annular channel surrounding tube bundle 15 and is introduced into tube bundle 15 at the bottom thereof. The mixture of feedwater and recirculating water than flows up through tube bundle 15 where it is heated to a boil by the water flowing within the tubes 25 of tube bundle 15. The steam produced by the boiling feedwater rises up into the steam drum portion 11 where the moisture separators 21 remove water entrained within the steam before the steam exits through a steam outlet nozzle 23. The steam then flows to a steam turbine (not shown) and subsequently back into the steam generator where the cycle is continued.

The U-shaped tubes 25 are supported along their straingt lengths in the configuration of the tube bundle 15 by a series of support plates 26. The bent or U-shaped portion of tubes 25 are supported by an assembly comprising retainer rings and antivibration bars. Each of the plurality of retainer rings **27*a*, 27*b* and 27*c* is generally of oval configuration with 27*b* being smaller than 27*a*, and 27*c* progressively smaller than 27*b*. A plurality of sets of antivibration bars 28 is disposed between adjacent columns of the U-shaped tubes 25. One such set of antivibration bars 28 is shown in FIG. 2, it being understood that successive sets of similar antivibration bars 28 are disposed behind and in front of the illustrated set. Each of the antivibration bars 28*a*, 28*b*, and 28*c* is of a V-shaped configuration with differing included angles and with the ends thereof attached, such as by welding, to symmetrically opposite points of the respective retainer rings 27*a*, 27*b* and 27*c*. FIG. 2 illustrates a cross-sectional schematic view taken through the tube bundle 15 showing that the antivibration bars 28*a*, 28*b* and 28*c* are disposed to support the bent or U-shaped portion of tubes 25**, noting the row and column arrangement of tubes 25. The number of retaining rings 27 and antivibration bars 28 depicted in FIG. 2 is merely for illustration purposes and is not intended to be a limiting consideration.

In steam generators 10 which are newly built, antivibration bars may comprise combinations of the expandable antivibration bar and the flexible compliant antivibration bars disclosed in the copending patent applications referenced above in the "Cross Reference to Related Applications" portion of this application. On the other hand, in steam generators 10 which were previously built and have been operated, the antivibration bars may comprise the prior art designs 28 which undesirably allow gaps to exist between the bars 28 and the steam generator flow tubes 25. In the latter type of steam generators, it is desirable to replace the prior art bars 28 with the new and advanced compliant and/or expandable antivibration bar 29.

In FIG. 2, it is to be assumed that antivibration bars 28 comprise the prior art bars and that antivibration bars 28*b* and 28*c* are to be replaced by new antivibration bars 29. Prior art bars 28*a* retaining ring 27*a* may be left in place or may be replaced with a variation of the hinged replacement bars described below. It is generally more desirable to remove the original antivibration bars and replace them with the antivibration bars as described. It will be noted that each pair of hinged antivibration bars 29 replaces one-half or one leg of prior art bars 28*b* and the adjacent one-half or one leg of prior art bars 28*c*. This unique arrangement allows for a small installed included angle 30 between each half or leg of antivibration bars 29 and facilitates remote installation procedures. Each half or leg of antivibration bars 29 are adjacent and parallel to each other when fitted within and are passed between the various internal components of steam generator 10 during installation of antivibration bars 29. Double hinge 31 allows for such side-by-side installation arrangement of the legs of the antivibration bars 29. Then, when fitted in place between the columns of flow tubes 25, the parallel halves of vibration bars are spread apart or hinged open into the installed position shown in FIG. 2. The prior art antivibration bars 28*b* and 28*c* may be removed after antivibration bars 29 are fitted between flow tubes 25 but before antivibration bars 29 are finally installed. In this manner, the existing space between columns of flow tubes is readily accessible to the antivibration bars 29 which may then easily be fitted between the columns of flow tubes 25. Such a procedure also eliminates the possibility of damage to the flow tubes 25 since the flow tubes 25 are already separated into spaced columns and, therefore, no additional force is required to separate any tubes 25 which would have repositioned themselves when the original antivibration bars 28 were removed.

Figure 3:
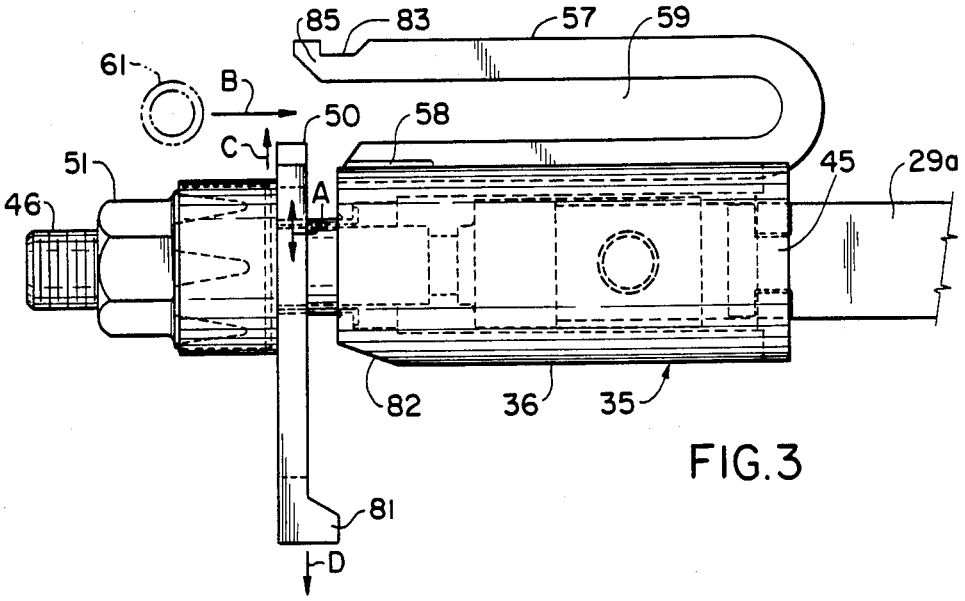
FIG. 3 is a plan view of the mechanical attachment mechanism as provided by the present invention and as applied to an expandable antivibration bar.
Figure 4:
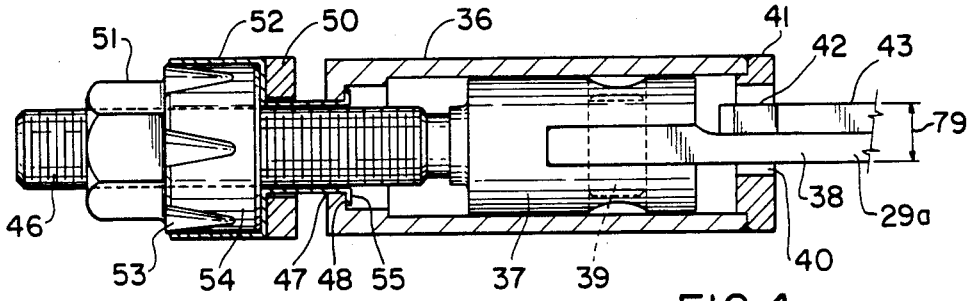
FIG. 4 is a side view of the apparatus of FIG. 3.

FIGS. 3 and 4 and FIGS. 5 and 6 illustrate the attachment of the mechanical attachment apparatus 35 to an expandable antivibration bar 29*a* and to a compliant antivibration bar 29*b*, respectively. In FIGS. 3 and 4 a cylindrical member 36 is fitted to the end of the antivibration bars 29. In the case of the expandable antivibration bars 29*a*, cylindrical member 36 is fitted over clevis 37 which is attached to lower bar 38 by pin 39. Lower bar 38 passes through an opening 40 in end cap 41 which may be welded to cylinder 36. End 42 of upper bar 43 and opening 40 may be mutually interlocking in the manner described in the referenced copending patent application entitled "Expandable Antivibration Bar for a Steam Generator" so as to retain the end 42 of bar 43 within opening 40.

Threaded stud 46 is attached to the remote end of clevis 37 and extends therefrom through an opening 47 in end cap 48, the latter of which may form an integral part of cylinder 36. A latch plate 50 is interposed between end cap 48 and nut 51 which is threadingly engaged onto stud 46. A locking cup 52 prevents the possibility of loose parts in the unlikely event of a fracture of stud 46. Locking cup 52 connects nut 51 with cylinder 36 when it is crimped into one or more of the detents 53 formed within a cylindrical portion 54 of nut 51, and by means of flange 55 which bears against end cap 48 within cylinder 36.

A hook-shaped member 57 is attached, such as by welding 58, to the cylindrical surface of cylinder member 36. Hook 57 is approximately the same length as cylindrical member 36 and is arranged such that the elongated opening 59 within hook 57 is aligned substantially parallel with the longitudinal axis of antivibration bar 29*a*. As will be later explaeind, a restraining ring 61 will be engaged within the openings 59 of hooks 57 of the antivibration bars 29 inserted between successive columns of flow tubes for the purpose of mechanically joining together the plurality of antivibration bars 29.

Figure 5:
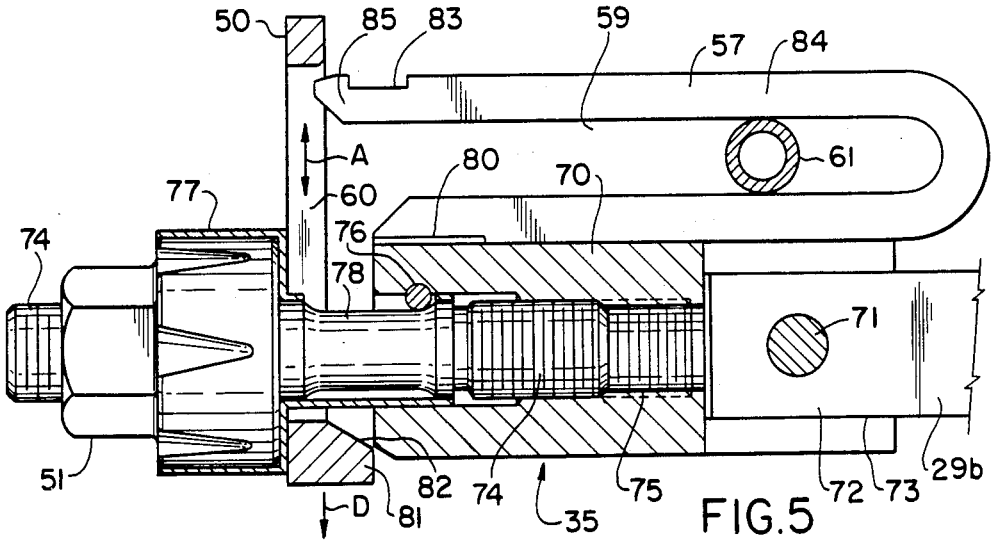
FIG. 5 is a plan view of the mechanical attachment apparatus as provided by the present invention and as applied to a passive or flexible antivibration bar.
Figure 6:
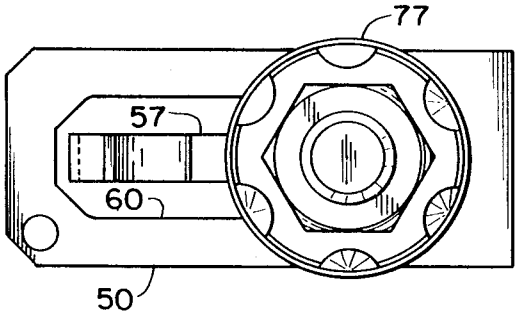
FIG. 6 is a top view of the apparatus of FIG. 5.

In FIGS. 5 and 6, it may be seen that a cylindrical member 70 is attached to the end 72 of a compliant antivibration bar 29*b* by a pin 71 which engages both cylinder 70 and bar 29*b*. End 72 of bar 29*b* fits within an opening 73 in cylinder 70. A stud 74 is threadingly engaged within a threaded opening 75 in cylinder 70 and extends therefrom away from bar 29 substantially coaxial with the longitudinal axis of bar 29*b*. Hook 57 is attached to cylinder 70 such as be welding 80. The length of which weld is variable in accordance with the strength desired in combination with the flexibility desired of the "U" configuration of hook member 57. Opening 59 in hook 75 is aligned with cylinder 70 much in the same manner as with cylinder 36. A locking cup 77 connecting nut 51 with cylinder 70 functions in the same manner as locking cup 52. However, a radial pin 76 rather than a flange connects locking cup 77 to cylinder 70. Radial pin 76 also prevents stud 74 from disengaging from cylinder 70 while allowing stud 74 to rotate and allows both nut 51 and stud 74 to travel axially in accordance with the position of pin 76 within undercut 78 in stud 74. It is to be observed that stud 74 is entirely passive as regards the function and operation of compliant antivibration bar 29*b*. In constrast, stud 47 in conjunction with cylinder 36 and nut 51 functions to move lower bar 38 relative to upper bar 43 and thereby increase or decrease the height 78 of expandable antivibration bar 29*a* as more fully described in the referenced copending patent application.

Latch plate 50 comprises an elongated plate having an elongated opening 60 therein. The length of opening 60 is slightly greater than the sum of the diameter of stud 46, the thickness of the wall of cylinder 36 and the height of hook 57 in FIGS. 3 and 4 and the diameter of stud 74, the thickness of the wall of cylinder 70 and the height of hook 57 in FIGS. 5 and 6. Latch plate 50 is allowed to slide back and forth relative to studs 46 and 74 in the direction of arrows A. In the unlatched and retracted position shown in FIG. 3, the opening 59 of hook 57 is open to receive the retaining ring 61 shown in phantom. In the ready-to-be latched position in FIG. 5, retaining ring 61 is shown received within opening 59 of hook 57. All of the antivibration bars 29 are installed in the unlatched condition, then the retaining ring 61 is inserted in the direction of arrow B (FIG. 3) into the opening 59 of the entire plurality of antivibration bars 29. The latch plates 50 slide in the direction of arrow B (FIG. 3) over the top 85 of hook 57. When nut 51 is drawn down by clockwise rotation, latch plate 50 is also drawn down and the angled projection 81 on the end of latch plate 50 meets with the angled surface 82 of cylinders 36 and 70 causing plate 50 to also move further in the direction of arrow D and thereby engage the detent 83 of end 85 of hook 57 and bend the free arm 84 of hook 57 toward cylinders 36 and 70. This movement causes a compressive load to be applied to retainer ring 61 which is captured within opening 59 of hooks 57 and thereby mechanically attach the antivibration bars *29a* and *29b* to retainer ring 61. The relatively long length of the opening 59 of hook 57 allows for a large deviation in the positioning of the antivibration bars 29 relative to the rows of flow tubes 25 and thereby allows for or accommodates a relatively wide range of positioning variability. Furthermore, the described method and apparatus of attaching the antivibration bars 29 to the retaining ring provides for firm attachments using mechanical elements and without welding inside the steam generator.

Figure 7:
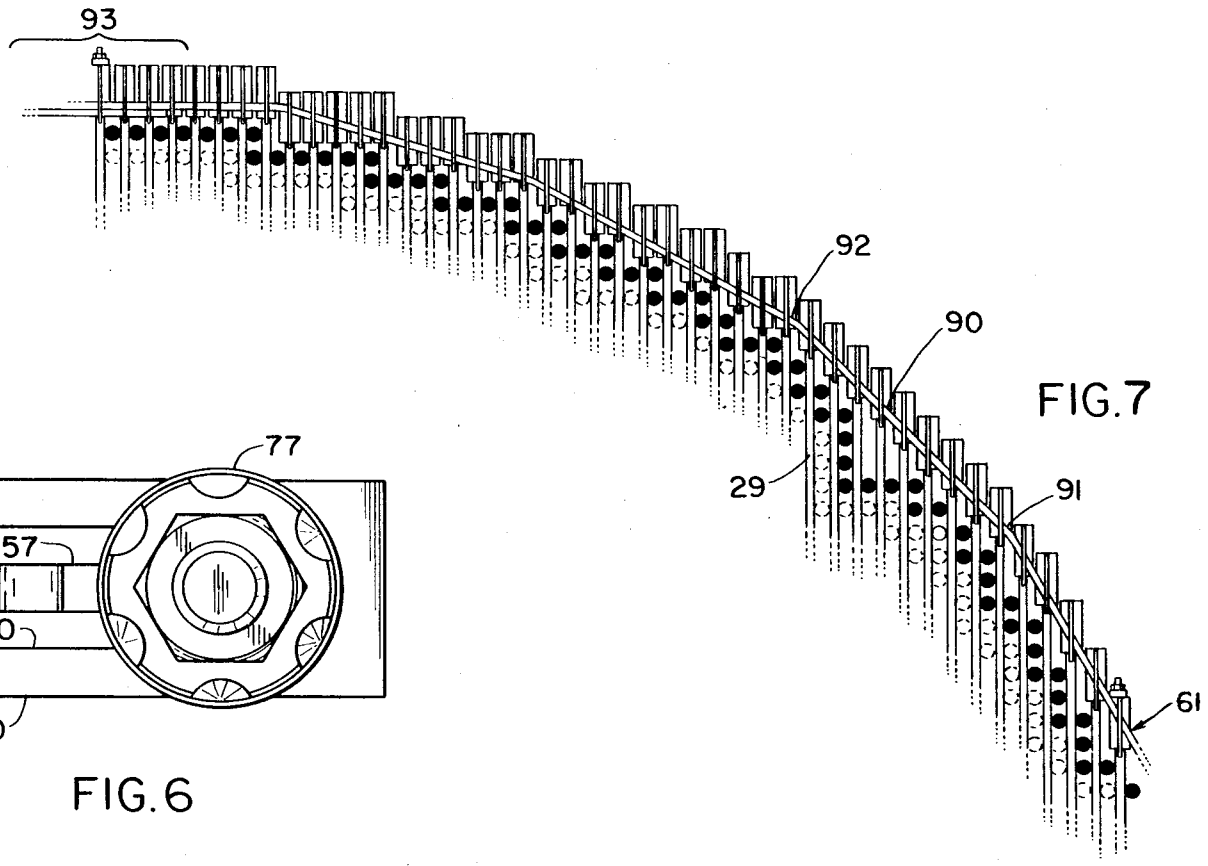
FIG. 7 is a schematic illustration of a number of antivibration bar attachment mechanisms attached to a retaining ring at the U-shaped portion of the flow tubes of a typical steam generator.

Referring now to FIG. 7, restraint ring 61 comprises an elongated bar bent in simple straight sections, such as section 90 which is located between bends 91 and 92, to form a generally curved ring conforming to the gross profile of the tube bundle 15 at the end locations of the antivibration bars 29. In the embodiment shown in the drawings, one ring 61 would be associated with each set of antivibration bars 29, replacing prior art bars 28 on each side of tube bundle 15, thus, two rings, 61' and 61", (FIG. 2) would be used. Each ring 61' and 61" would have an overall shape approximating the double curvature of the periphery of a saddle. Moreover, each ring 61' and 61" need not comprise a single piece but may be made up of a number of connecting lengths, the ends of which would overlap and be connected to a plurality of the same mechanical attachment apparatus 25 as shwon in region 93 of FIG. 7. In FIG. 7, the darkened points represent the tube bundle 15 profile.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved, especially as they fall within the breadth and scope of the claims here appended.

We claim as our invention:

1. A steam generator for a nuclear power plant comprising a shell, a tube bundle comprising a plurality of tubes having an approximate U-shaped configuration arranged in successive columns and rows within said shell, said tubes being adapted to heat feedwater flowing around the outside of said tubes, antivibration means for substantially eliminating vibrations of said tubes as a result of steam generator operation, said antivibration means comprising compliant or expandable antivibration bars fitted between successive columns and within the U-shaped portion of said tubes, said antivibration bars being mechanically attached at the ends thereof to a retaining ring arranged around the outer periphery of said tube bundle at the U-shaped portion thereof, said mechanical attachment comprising a latch and a hook, said hook being attached to a hollow member which is attached to an end of said vibration bar, said retaining ring fitting within said hook, said latch comprising a plate slidingly arranged with said hook and fitting across the open end of said hook whereby said retaining ring is captured within said hook when said latch is slid over the open end of said hook, said latch being further movable relative to said hook in a direction perpendicular to the longitudinal axis of said antivibration bar, and said latch includes a first tapered surface which mates with a second tapered surface included with said hollow member whereby longitudinal motion of said latch results in a wedging action between said latch and hook and whereby a detent within the unconnected end of said hook fits within and is captured by the end of an opening in said latch causing said hook to close downward onto said retaining ring and applying a compressive force thereto.

2. The apparatus of claim 1, including an elongated threaded member extending from said hollow member in said longitudinal direction, and a nut threadingly engaged with said elongated threaded member, whereby rotation of said nut causes said longitudinal motion of said latch.

3. The apparatus of claim 2, wherein said antivibration bar comprises an expandable bar having a movable bar and a stationary bar with said elongated member being attached to said movable bar and further rotation of said nut causes relative motion between said two bars thereby expanding the effective thickness of said expandable antivibration bar.

* * * * *